US007913330B2

(12) United States Patent
King

(10) Patent No.: US 7,913,330 B2
(45) Date of Patent: Mar. 29, 2011

(54) DISPENSING APPARATUS

(76) Inventor: Joseph A. King, Wayzata, MN (US)

( * ) Notice: Subject to any disclaimer, the term of this patent is extended or adjusted under 35 U.S.C. 154(b) by 196 days.

(21) Appl. No.: 12/284,847

(22) Filed: Sep. 25, 2008

(65) Prior Publication Data

US 2009/0025140 A1 Jan. 29, 2009

Related U.S. Application Data

(62) Division of application No. 11/082,436, filed on Mar. 17, 2005, now Pat. No. 7,478,442.

(51) Int. Cl.
*E04H 4/00* (2006.01)

(52) U.S. Cl. ..... 4/498; 4/222

(58) Field of Classification Search ..... 4/496, 222, 4/225, 227.1, 231, 498
See application file for complete search history.

(56) References Cited

U.S. PATENT DOCUMENTS

| | | | | |
|---|---|---|---|---|
| 1,950,139 | A * | 3/1934 | French | 4/227.1 |
| 3,398,862 | A * | 8/1968 | Willis | 222/57 |
| 6,651,260 | B1 * | 11/2003 | Dodson | 4/227.1 |
| 6,944,890 | B1 * | 9/2005 | Sim | 4/225.1 |
| 6,993,795 | B2 * | 2/2006 | Prineppi | 4/227.1 |
| 7,238,280 | B1 * | 7/2007 | King | 210/136 |
| 2002/0139757 | A1 * | 10/2002 | Connelly, Jr. | 210/749 |

* cited by examiner

*Primary Examiner* — Huyen Le
(74) *Attorney, Agent, or Firm* — Jacobson & Johnson

(57) ABSTRACT

A dispenser delivery system for a closed container that permits periodic dispensing of a dispersant into a fluid in the container without having to remove a cover over the container.

5 Claims, 3 Drawing Sheets

DISPENSING APPARATUS

CROSS REFERENCE TO RELATED APPLICATIONS

This application is a divisional application of U.S. patent application Ser. No. 11/082,436 filed on Mar. 17, 2005 now U.S. Pat. No. 7,478,442 titled DISPENSING APPARATUS.

FIELD OF THE INVENTION

This invention relates generally to delivery systems and more specifically a container and dispenser combination for periodically delivering materials to a body of water.

STATEMENT REGARDING FEDERALLY SPONSORED RESEARCH OR DEVELOPMENT

None

REFERENCE TO A MICROFICHE APPENDIX

None

BACKGROUND OF THE INVENTION

The concept of containers that hold a body of water for human use are well known in the art. One such container that holds a recreational body of water is known as a spa or hot tub. Spas and hot tubs are used in all types of climates and are generally maintained at a comfortable temperature so that a person can immerse himself or herself in the body of water. Generally, the spas or hot tubs are located outdoors. In colder climates this means that even though the outside temperature may be below freezing the temperature of the body of recreational water in the spa or hot tub needs to be maintained well above the freezing point. As bacteria and other organisms can grow in the body of water it is necessary to periodically apply disinfectants or other water treatment materials to the body of water to bring the water to proper recreational levels. Oftentimes the use of the spa or hot tub can be sporadic; however it is still necessary to periodically attend to maintaining the proper quality of the recreational water. In the wintertime this can entail the user removing the cover from the spa and dispensing the proper materials into the water to bring the water quality up to a level for recreational use. The cover is then placed back on the spa or hot tub. If the weather is cold the user might procrastinate or neglect to attend to the dispensing of materials until the weather warms up. At other times the user may be on vacation for a length of time. In each case it is desirable that the user periodically dispense the materials into the body of recreational water even though the weather is inclement or the user is on vacation. The present invention provides a dispensing system for a body of water that can use the latent heat of the body off water to maintain the dispersant in a deliverable state for periodic delivery either through a manual activation or through a timer that periodically dispenses the dispersant into the body of water.

BRIEF SUMMARY OF THE INVENTION

Briefly, the invention includes a dispenser delivery system for a closed container that permits periodic dispensing of a dispersant into a fluid in the container without having to remove a cover over the container. In one embodiment the dispenser can be filled or activated through controls extending through a cover to the dispensing delivery system and in another a timer contained within the container can be set to periodically deliver dispersant to the body of fluid in the container.

DESCRIPTION OF THE PREFERRED EMBODIMENT

Figure 1:
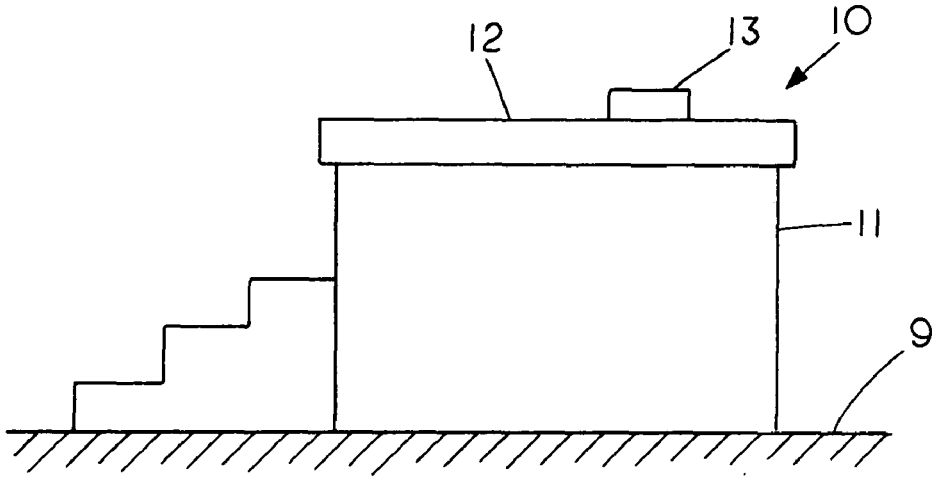
FIG. 1 is a side view of a spa with a cover.

FIG. 1 is a front view of spa or hot tub 10 that is located on a platform 9. The spa includes a container 11 with a cover 12 that extends over the container to keep the body of recreational water therein free of debris. A thermostatic controlled heater maintains the proper temperature of the water in the container. In addition the cover and container generally include insulation to help maintain the water at the proper temperature.

Located on top of cover 10 is a hood 13 that extends over a set external controls for the delivery of dispersants from a dispenser located in the air space beneath the cover and the body of water and preferably as an attachment to the cover.

Figure 2:
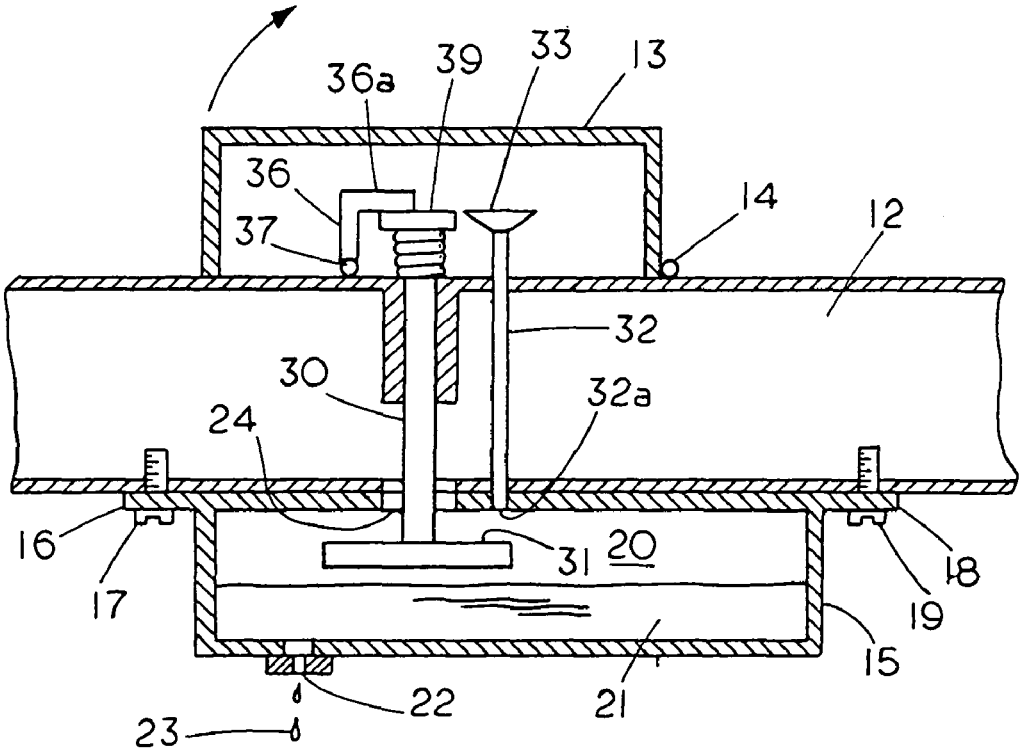
FIG. 2 is a partial section view of the cover of the spa of FIG. 1 with a dispenser delivery system in a delivery mode.

FIG. 2 shows a partial cross sectional view of the cover 12 and hood 14 to reveal the dispending system for periodically dispensing dispersant into the body of water in the spa. Located on the underside of cover 12 is a dispenser 15 that has a first ear 16 that is secured to cover 12 through a screw 17 and a second ear 18 that are secured to cover 12 through a screw 19.

FIG. 2 shows the dispenser in the dispensing position as well as the external filling condition. Located within container 15 is a dispersant 21. An aperture 22 in the lower portion of dispenser 15 provides for gravity feed of dispersants from chamber 21 in dispenser 15. An external supply tube 32 extends upward to a funnel 33 that allows one to inject dispersant into the container 15 by pivoting back hood 13 without having to open the cover 12. Positioned alongside of tube 32 is a push rod 30 that has a sealing member 31 on one end and a handle 39 on the opposite end. An L shaped latch member 36 having a hinge 37 is shown with surface **36*a* holding push rod 30** in the open position.

With the push rod 30 is in the dispensing position as shown in FIG. 2 the dispersant 21 in chamber 20 can be delivered to the body of water through the aperture or port 22. In addition a fresh charge of dispersant can be added to the dispenser 15 by pivoting hood 13 about hinge 14 to expose the funnel 3 for insertion of dispersant therein, which will flow through tube 32 an into the chamber 20. The embodiment of FIG. 2 allows one to deliver dispersant at a controlled rate even though a person is not present since droplets of dispersant 23 can be emitted from port 22 through a drip feed. By sizing the port 22 for the dispersants one can control the dispersant rate. For example, if the dispersant is of the type that needs to be delivered all at once a larger delivery port can be used. On the other hand if the dispersant is of the type that should be delivered over an extended period of time a small delivery port can be used and the dispersant can be allowed to drip feed into the body of water.

Figure 3:
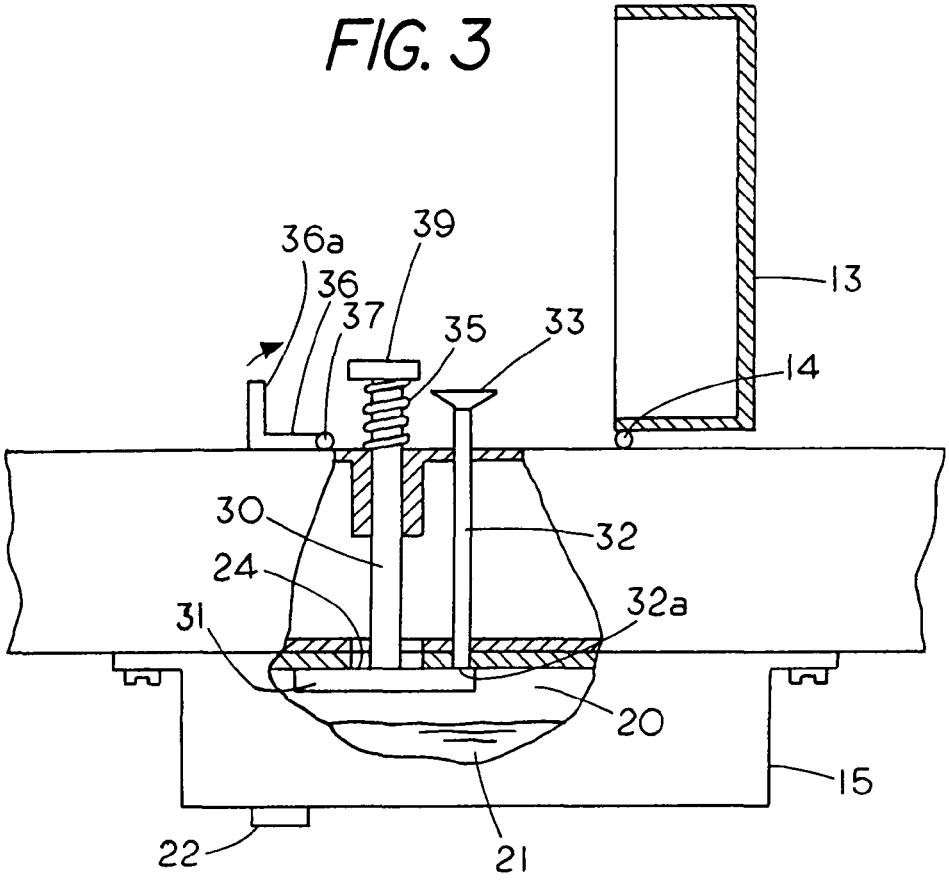
FIG. 3 is a partial sectional view of the cover of the spa of FIG. 1 in a closed or non-delivery condition.

FIG. 3 shows the dispensing system of FIG. 2 in the non-dispensing condition. Hood 13 has been pivoted back on hinge 14 to reveal how the hood can be swung to an out of the way. In addition the latch member 36 has been pivoted to an unlatched condition by rotating latch member 90 degrees about hinge 37. As the compression spring 35 around push rod 30 exerts an upward force on handle 39 it brings the handle to the up condition, which brings the sealing member 24 to a closed condition that closes the top opening 24. Sealing the container 15 has two effects first, it prevents any dispersant from escaping form container 15 since air cannot enter or escape from the container 15. In this condition one can manually operate the dispenser by pushing down on the handle 39 to allow air to enter chamber 20 thereby allowing the dispersant therein to be dispensed into the body of recreational water. Second, by pushing down on handle 39 one also permits the addition of additional dispersant to chamber 20 (see FIG. 2) since the end 32*a* becomes unsealed to allow the dispenser to flow into chamber 20.

Thus, the embodiment of FIG. 2 and FIG. 3 allow for both on demand manual deliver or extended dispersant delivery without the user having to open the cover 12 of the spa or hot tub. As a result the delivery of the dispersant to the body of recreational becomes easier since the large cover need not be removed from the container, which generally means there is less tendency to neglect or procrastinate on the regular treatment of the water in the container.

Figure 4:
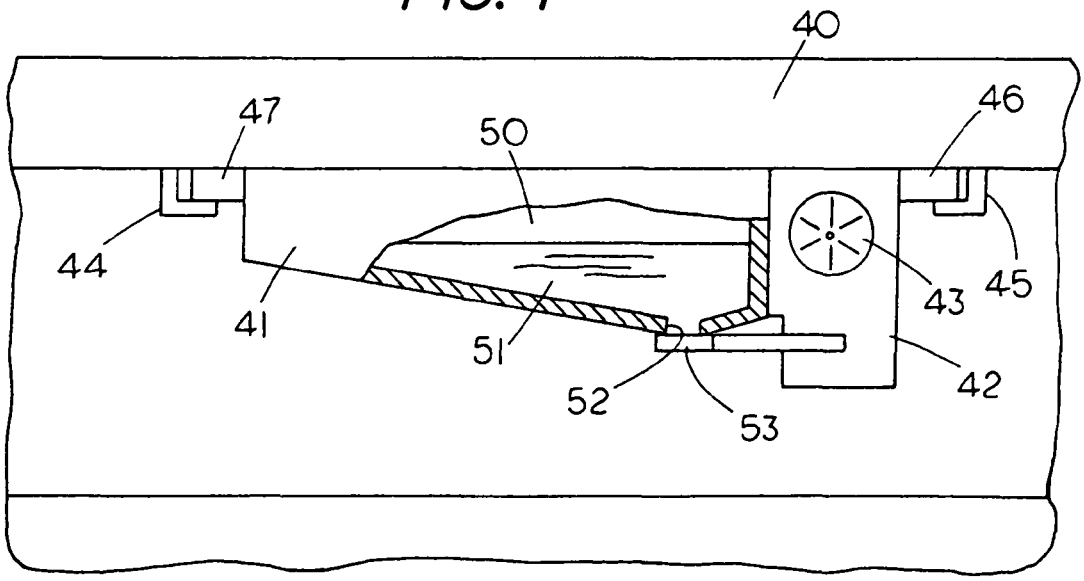
FIG. 4 is a partial section of a spa cover with a timer controlled dispenser delivery system in the non-delivery mode.

FIG. 4 shows an alternate embodiment of the invention that cans also delivery dispersant without having to remove the cover of the hot tub. The embodiment of FIG. 4 includes a timer for controlling the delivery of the dispersant to the body of water and a shutoff member to stop or start deliver of dispersant.

FIG. 4 shows a portion of a cover 40 with a first member or lip 44 secured to one portion of the cover and a second L shaped member or lip 45 secured to another portion of the cover. The purpose of lips 44 and 46 is to allow one to quickly attach a dispenser 41 to the underside of cover 40 so the dispenser can be held in a ready to use condition. That is, one can attach or detach a dispenser 41 to the underside of cover 40 by merely sliding the dispenser along the underside of the cover until dispenser flange 47 and dispenser flange 46 engage their respective lips. In this condition the dispenser is in a ready to use condition beneath the cover 40. The dispenser can be provided with one or more dispersants and can contain enough dispersants for many months. With the dispenser 41 located in the air space above the body of water the latent heat of the water can maintain the dispersant in a non-freezing condition, this is particular beneficial when the dispersant is or contains a liquid. On the other hand, a solid dispersant which may be in tablet or granular form can also be used with the dispenser 41.

The embodiment of FIG. 4 differs from the embodiment of FIG. 2 in that the dispenser 41 includes a shutoff member 53 that can be controlled by a timer 42. Timer 42 includes a dial 43 for setting the time of day as well as the day of delivery of material from dispenser 41. Dispenser 41 is shown in partial section having a liquid dispersant 51 in chamber 50. In the embodiments shown a sealing member or shutoff member 53 extends laterally across port 52 to prevent egress of dispersant from chamber 50. The sealing member is controlled by the timer 42. FIG. 4 shows the shutoff member 53 in the closed condition.

Figure 5:
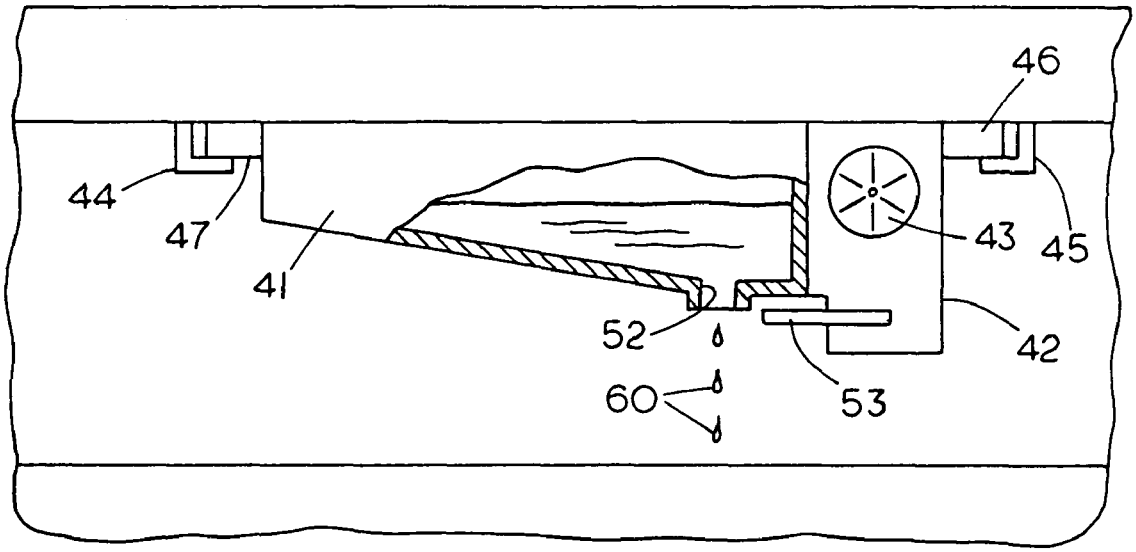
FIG. 5 is a partial section view of a spa cover with the time controlled dispenser delivery system of FIG. 4 in the dispensing mode.

FIG. 5 shows the dispenser 41 in the dispensing condition. In this condition the port 52 has been uncovered as the sealing or shutoff member 53 has been slid laterally toward the right until the port 52 is open. In this condition the dispersant 60 can escape from dispenser 41. When sufficient amount of dispersant has been discharged the timer closes the port 52 by extending sealing member 53 there across as shown in FIG. 4.

Thus in the embodiment of FIG. 4 and FIG. 5 one can periodically deliver dispersant to the spa or hot tub even though one might not be present. In addition since the delivery system is contained in the air chamber and above the water line or a fluid gas interface line the latent heat of the water as well as the insulation of the cover allow the dispersant to be maintained in a condition that permits delivery of dispersant.

In both embodiments the user need not remove the cover once a charge of dispersant has been placed in the dispenser. Depending on the type of dispersant required as well as the frequency of deliver either the dispersant delivery system of FIG. 2 and FIG. 3 or the dispersant delivery system of FIG. 3 and FIG. 4 or both can be used to timely deliver the dispersant to the body of fluid contained in the container. Thus the present invention provides for undercover delivery of a dispersant without the user having to remove the cover each time a charge of dispersant is delivered to the container.

While the present invention has been described in relation to spa or hot tubs, once the present invention is known it will be envisioned that the dispensing apparatus of the present invention can be used with a variety of fluids that require periodic maintenance as well as other systems that require periodic maintenance of the fluid in the system.

I claim:

1. A spa dispenser delivery system comprising:

a spa having a container for holding a body of fluid;

a spa cover extendible over said container to form an enclosure around the body of fluid; and a dispenser located in the enclosure with the dispenser discharging a dispersant when the spa cover and the container are in a closed condition, said dispenser including a timer, said timer directly controlling the opening and closing of a sealing member located on the dispenser for periodic delivery of the dispersant directly into the body of fluid.

2. A spa dispenser delivery system comprising:

a spa having a container for holding a body of recreational fluid;

a cover extendible over said container to form an enclosure around the body of fluid; and a dispenser located in the enclosure with the dispenser discharging a dispersant directly into the body of fluid when the cover and the container are in a closed condition, said dispenser including a slidable shutoff member for opening and closing a dispersant delivery port on the dispenser wherein the dispenser is confined within an enclosure between the cover and the container.

3. A spa dispenser delivery system comprising:

a spa having a container for holding a body of recreational fluid;

a cover extendible over said container to form an enclosure around the body of recreational fluid; and a dispenser located in the enclosure with the dispenser discharging a dispersant directly into the body of recreational fluid when the cover and the container are in a closed condition, said dispenser is removably attachable to an underside of the cover.

4. A spa dispenser delivery system comprising:

a spa having a container for holding a body of recreational fluid;

a cover extendible over said container to form an enclosure around the body of recreational fluid; and a dispenser located in the enclosure with the dispenser discharging a dispersant directly into the body of recreational fluid when the cover and the container are in a closed condition, said dispenser containing a solid dispersant.

5. A method of periodic delivery of a dispersant to a closed spa system comprising:

forming a container for holding a body of recreational fluid;

forming a spa cover for extending over the container to form a closed container;

placing a dispenser in the closed container;

attaching a timer to the dispenser to control the delivery of the dispersant; and periodically dispensing the dispersant from the dispenser directly into the body of recreational fluid without removing the spa cover from the container.

* * * * *